US005183558A

United States Patent [19]

Owen et al.

[11] Patent Number: 5,183,558

[45] Date of Patent: Feb. 2, 1993

[54] HEAVY OIL CATALYTIC CRACKING PROCESS AND APPARATUS

[75] Inventors: Hartley Owen, Belle Mead, N.J.; Paul H. Schipper, Wilmington, Del.

[73] Assignee: Mobil Oil Corporation, Fairfax, Va.

[21] Appl. No.: 636,463

[22] Filed: Dec. 31, 1990

[51] Int. Cl.[5] ..... C10G 11/00

[52] U.S. Cl. ..... 208/113; 208/156; 208/161; 502/43

[58] Field of Search ..... 208/113, 156, 161; 502/43

[56] References Cited

U.S. PATENT DOCUMENTS

| | | | |
|---|---|---|---|
| 3,926,778 | 12/1975 | Owen et al. | 208/74 |
| 4,810,360 | 3/1989 | Haddad et al. | 208/153 |
| 4,812,430 | 3/1989 | Child | 208/113 |
| 4,814,068 | 3/1989 | Herbst et al. | 208/155 |
| 4,822,761 | 4/1989 | Walters et al. | 502/38 |
| 4,853,187 | 8/1989 | Herbst et al. | 422/144 |
| 4,868,144 | 9/1989 | Herbst et al. | 502/43 |
| 5,011,592 | 4/1991 | Owen et al. | 208/113 |

FOREIGN PATENT DOCUMENTS 0259115 9/1988 European Pat. Off. .

*Primary Examiner*—Theodore Morris
*Assistant Examiner*—William C. Diemler
*Attorney, Agent, or Firm*—Alexander J. McKillop; Charles J. Speciale; Richard D. Stone

[57] ABSTRACT

A process and apparatus for fluidized catalytic cracking of heavy oils is disclosed using a modified high efficiency catalyst regenerator. A fast fluidized bed coke combustor, which is essentially free of gas/catalyst separation means, partially regenerates catalyst and discharges a steam laden flue gas and catalyst into a dilute phase transport riser. Closed cyclones separate catalyst from steam laden flue gas exiting the transport riser outlet. This flue gas is isolated from a second fluidized bed of catalyst maintained in a vessel containing the transport riser and closed cyclones. Coke combustion in the drier region of the second fluidized bed is possible. Catalyst deactivates less in the second fluidized bed because it is drier.

11 Claims, 2 Drawing Sheets

HEAVY OIL CATALYTIC CRACKING PROCESS AND APPARATUS

BACKGROUND OF THE INVENTION

1. FIELD OF THE INVENTION

The field of the invention is regeneration of coked cracking catalyst in a fluidized bed.

2. DESCRIPTION OF RELATED ART

Catalytic cracking is the backbone of many refineries. It converts heavy feeds into lighter products by catalytically cracking large molecules into smaller molecules. Catalytic cracking operates at low pressures, without hydrogen addition, in contrast to hydrocracking, which operates at high hydrogen partial pressures. Catalytic cracking is inherently safe as it operates with very little oil actually in inventory during the cracking process.

There are two main variants of the catalytic cracking process: moving bed and the far more popular and efficient fluidized bed process.

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst The hot catalyst vaporizes and cracks the feed at 425° C.-600° C., usually 460° C.-560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500° C.-900° C., usually 600° C.-750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, which is recycled to the reactor in the form of hot catalyst.

Catalytic cracking has undergone progressive development since the 40s. The trend of development of the fluid catalytic cracking (FCC) process has been to all riser cracking and use of zeolite catalysts.

Riser cracking gives higher yields of valuable products than dense bed cracking. Most FCC units now use all riser cracking, with hydrocarbon residence times in the riser of less than 10 seconds, and even less than 5 seconds.

Zeolite-containing catalysts having high activity and selectivity are now used in most FCC units. These catalysts work best when coke on the catalyst after regeneration is less than 0.1 wt %, and preferably less than 0.05 wt %.

To regenerate FCC catalysts to these low residual carbon levels, and to burn CO completely to CO2 within the regenerator (to conserve heat and minimize air pollution) many FCC operators add a CO combustion promoter metal to the catalyst or to the regenerator.

U.S. Pat. No. 4,072,600 and 4,093,535, which are incorporated by reference, teach use of combustion-promoting metals such as Pt, Pd, Ir, Rh, Os, Ru and Re in cracking catalysts in concentrations of 0.01 to 50 ppm, based on total catalyst inventory.

As the process and catalyst improved, refiners attempted to use the process to upgrade a wider range of feedstocks, in particular, feedstocks that were heavier, and also contained more metals and sulfur than had previously been permitted in the feed to a fluid catalytic cracking unit.

These heavier, dirtier feeds have placed a growing demand on the regenerator. Processing resids has exacerbated four existing problem areas in the regenerator, sulfur, steam, temperature and NOx. These problems will each be reviewed in more detail below.

SULFUR

Much of the sulfur in the feed ends up as SOx in the regenerator flue gas. Higher sulfur levels in the feed, combined with a more complete regeneration of the catalyst in the regenerator increases the amount of SOx in the regenerator flue gas. Some attempts have been made to minimize the amount of SOx discharged to the atmosphere through the flue gas by including catalyst additives or agents to react with the SOx in the flue gas. These agents pass with the regenerated catalyst back to the FCC reactor where the reducing atmosphere releases the sulfur compounds as H2S. Suitable agents are described in U.S. Pat. Nos. 4,071,436 and 3,834,031. Use of cerium oxide agent for this purpose is shown in U.S. Pat. No. 4,001,375.

Unfortunately, the conditions in most FCC regenerators are not the best for SOx adsorption. The high temperatures in modern FCC regenerators (up to 870° C. (1600° F.)) impair SOx adsorption. One way to minimize SOx in flue gas is to pass catalyst from the FCC reactor to a long residence time steam stripper, as disclosed in U.S. Pat. No. 4,481,103 to Krambeck et al which is incorporated by reference. This process preferably steam strips spent catalyst at 500° C.-550° C. (932° to 1022° F.), which is beneficial but not sufficient to remove some undesirable sulfur- or hydrogen-containing components.

STEAM

Steam is always present in FCC regenerators although it is known to cause catalyst deactivation. Steam is not intentionally added, but is invariably present, usually as adsorbed or entrained steam from steam stripping or catalyst or as water of combustion formed in the regenerator.

Poor stripping leads to a double dose of steam in the regenerator, first from the adsorbed or entrained steam and second from hydrocarbons left on the catalyst due to poor catalyst stripping. Catalyst passing from an FCC stripper to an FCC regenerator contains hydrogen-containing components, such as coke or unstripped hydrocarbons adhering thereto. This hydrogen burns in the regenerator to form water and cause hydrothermal degradation.

U.S. Pat. No. 4,336,160 to Dean et al, which is incorporated by reference, attempts to reduce hydrothermal degradation by staged regeneration. However, the flue gas from both stages of regeneration contains SOx which is difficult to clean. It would be beneficial, even in staged regeneration, if the amount of water precursors present on stripped catalyst was reduced.

Steaming of catalyst becomes more of a problem as regenerators get hotter. Higher temperatures greatly accelerate the deactivating effects of steam.

TEMPERATURE

Regenerators are operating at higher and higher temperatures. This is because most FCC units are heat balanced, that is, the endothermic heat of the cracking reaction is supplied by burning the coke deposited on the catalyst. With heavier feeds, more coke is deposited on the catalyst than is needed for the cracking reaction. The regenerator gets hotter, and the extra heat is rejected as high temperature flue gas. Many refiners severely limit the amount of resid or similar high CCR feeds to that amount which can be tolerated by the unit. High temperatures are a problem for the metallurgy of many units, but more importantly, are a problem for the catalyst. In the regenerator, the burning of coke and unstripped hydrocarbons leads to much higher surface temperatures on the catalyst than the measured dense bed or dilute phase temperature. This is discussed by Occelli et al in Dual-Function Cracking Catalyst Mixtures, Ch. 12, Fluid Catalytic Cracking, ACS Symposium Series 375, American Chemical Society, Washington, D.C., 1988.

Some regenerator temperature control is possible by adjusting the CO/CO2 ratio produced in the regenerator. Burning coke partially to CO produces less heat than complete combustion to CO2. However, in some cases, this control is insufficient, and also leads to increased CO emissions, which can be a problem unless a CO boiler is present.

U.S. Pat. No. 4,353,812 to Lomas et al, which is incorporated by reference, discloses cooling catalyst from a regenerator by passing it through the shell side of a heat-exchanger with a cooling medium through the tube side. The cooled catalyst is recycled to the regeneration zone. This approach will remove heat from the regenerator, but will not prevent poorly, or even well, stripped catalyst from experiencing very high surface or localized temperatures in the regenerator.

The prior art also used dense or dilute phase regenerated fluid catalyst heat removal zones or heat-exchangers that are remote from, and external to, the regenerator vessel to cool hot regenerated catalyst for return to the regenerator. Examples of such processes are found in U.S. Pat. Nos. 2,970,117 to Harper; 2,873,175 to Owens; 2,862,798 to McKinney; 2,596,748 to Watson et al; 2,515,156 to Jahnig et al; 2,492,948 to Berger; and 2,506,123 to Watson.

NOX

Burning of nitrogenous compounds in FCC regenerators has long led to creation of minor amounts of NOx, some of which were emitted with the regenerator flue gas. Usually these emissions were not much of a problem because of relatively low temperature a relatively reducing atmosphere from partial combustion of CO and the absence of catalytic metals like Pt in the regenerator which increase NOx production.

Many FCC units now operate at higher temperatures, with a more oxidizing atmosphere, and use CO combustion promoters such as Pt. These changes in regenerator operation reduce CO emissions, but usually increase nitrogen oxides (NOx) in the regenerator flue gas. It is difficult in a catalyst regenerator to completely burn coke and CO in the regenerator without increasing the NOx content of the regenerator flue gas, so NOx emissions are now frequently a problem.

An approach that minimized steaming and NOx production was reported in U.S. Pat. No. 4,853,187 and European Patent Application EP 0 259 115 A2, both of which are incorporated herein by reference. Both disclose multi-stage regeneration of catalyst in high efficiency regenerators, but ones with catalyst/flue gas separators at each stage of the process. A cyclone separator is added to the coke combustor, and a the transport riser outlet discharges into another cyclone separator. Such an approach will be highly effective at minimizing steaming of catalyst, and will reduce NOx emissions, but requires significant modifications to include a catalyst flue gas separation means in the coke combustor. The fast fluidized bed coke combustor in most refineries is cramped for space, and it is difficult to place and support cyclones, and the flue gas line needed to remove separated flue gas from the coke combustor.

We studied these units, and realized that the most difficult part of the installation, the cyclone separator in the coke combustor, and its accompanying flue gas line, was also the most dispensable. Although quite a lot of water of hydration can be formed in a riser mixer upstream of a coke combustor, we realized that the residence time, and temperature, in the coke combustor were sufficiently low so that we could achieve much of the benefits of the system disclosed in U.S. Pat. No. 4,814,068, while avoiding much of the cost. We especially wanted to avoid putting a critical part of the unit in the coke combustor, which has one or the most severe erosive environments to be found in a catalyst regenerator.

We discovered a way to have efficient, staged regeneration of catalyst with reduced hydrothermal degradation in a way that could be readily implemented in existing high efficiency regenerators, with minimal modifications to the upper portions or the unit, and with no modifications whatever to the coke combustor.

BRIEF SUMMARY OF THE INVENTION

Accordingly, the present invention provides a fluidized catalytic cracking process wherein a heavy hydrocarbon feed comprising hydrocarbons having a boiling point above about 650° F. is catalytically cracked to lighter products comprising the steps of: catalytically cracking said feed in a catalytic cracking zone operating at catalytic cracking conditions by contacting said feed with a source of hot regenerated catalyst to produce a cracking zone effluent mixture having an effluent temperature and comprising cracked products and spent cracking catalyst containing strippable hydrocarbons and coke comprising carbon and hydrogen, and; separating said cracking zone effluent mixture into a cracked product rich vapor phase and a solids rich phase comprising said spent catalyst and strippable hydrocarbons, said solids rich phase having a temperature; stripping said catalyst mixture with a stripping gas to remove strippable compounds from spent catalyst and produce a stripped catalyst having a temperature; regenerating said stripped catalyst by contacting said catalyst with oxygen or an oxygen containing gas in a dense phase fluidized bed coke combustor comprising a fluidized bed with inlets for oxygen containing gas and for spent catalyst, and an overhead outlet for at least partially regenerated catalyst and flue gas comprising CO2 and water vapor formed by combustion of carbon and hydrogen in said coke, wherein said coke combustor is essentially free of catalyst/gas separation means and said coke combustor is below, and in open fluid communication with, a superimposed, dilute phase transport riser having an opening at the base connective with said coke combustor which transports at least partially regenerated catalyst and flue gas from the base of the riser to an outlet at an upper portion thereof; discharging and immediately separating in a cyclone separation means catalyst and flue gas comprising water vapor discharged as a dilute phase from said dilute phase transport riser outlet into a catalyst rich phase and a water vapor rich flue gas phase gas rich phase comprising over 90% of the water formed by combustion of hydrogen in said coke and discharging said separated catalyst down from said cyclones to form a second fluidized bed of catalyst maintained as a fluidized bed about said transport riser, and having a dilute phase region above said second fluidized bed, and discharging said separated water vapor rich flue gas phase into a flue gas removal means which is isolated from and closed to said second fluidized bed and the dilute phase vapor region above said second fluidized bed and adapted to remove flue gas from said regeneration means; and recycling to the catalytic cracking process a hot regenerated catalyst stream obtained from said second fluidized bed.

In another embodiment, the present invention provides a fluidized catalytic cracking process wherein a heavy hydrocarbon feed comprising hydrocarbons having a boiling point above about 650° F. is catalytically cracked to lighter products comprising the steps of: catalytically cracking said feed in a catalytic cracking zone operating at catalytic cracking conditions by contacting said feed with a source of hot regenerated catalyst to produce a cracking zone effluent mixture having an effluent temperature and comprising cracked products and spent cracking catalyst containing coke comprising carbon and hydrogen, and strippable hydrocarbons; separating said cracking zone effluent mixture into a cracked product rich vapor phase and a solids rich phase comprising said spent catalyst and strippable hydrocarbons said solids rich phase having a temperature; stripping said catalyst mixture with a stripping gas to remove strippable compounds from spent catalyst; regenerating said stripped catalyst by contacting said catalyst with oxygen or an oxygen containing gas in a dense phase fluidized bed coke combustor comprising a fluidized bed with inlets for oxygen containing gas and for spent catalyst, and an overhead outlet for at least partially regenerated catalyst and flue gas, comprising CO2 and water formed by combustion of carbon and hydrogen in said coke, wherein said coke combustor is essentially free of catalyst/gas separation means and is beneath and open to a superimposed, dilute phase transport riser having an opening at the base connective with said coke combustor which transports at least partially regenerated catalyst and flue gas from the base of the riser to an outlet at an upper portion thereof; discharging and immediately separating said at least partially regenerated catalyst and flue gas gas comprising water formed by combustion from said dilute phase riser outlet via at least one cyclone separator means having an inlet connective with said outlet of said transport riser, said cyclone separator having a catalyst outlet comprising a dipleg which discharges recovered catalyst down to form a second fluidized bed and discharges recovered vapor via a vapor outlet connected with a flue gas outlet means which removes discharged flue from the regenerator without impinging on or agitating said second fluidized bed; maintaining an inventory of catalyst in said second fluidized bed sufficient to provide a catalyst residence time therein of at least about 1 minute; adding to said second fluidized bed at least 5% of the oxygen or oxygen containing gas added to the regenerator and maintaining a superficial vapor velocity in said second fluidized bed of at least 0.25 feet per second and removing in said second fluidized bed at least 10% of the carbon content of the coke on spent catalyst, and recycling to the catalytic cracking process hot regenerated catalyst from said second fluidized bed.

In an apparatus embodiment, the present invention provides an apparatus for the fluidized catalytic cracking of a heavy hydrocarbon feed comprising hydrocarbons having a boiling point above about 650° F. to lighter products by contact said feed with catalytic cracking catalyst comprising: a catalytic cracking reactor means having an inlet connective with a source of said feed and with a source of hot regenerated catalyst and having an outlet for discharging a cracking zone effluent mixture comprising cracked products and spent cracking catalyst containing coke and strippable hydrocarbons; a separation means connective with said reactor outlet for separating said cracking zone effluent mixture into a cracked product rich vapor phase and a solids rich phase comprising said spent catalyst and strippable hydrocarbons; a stripping means comprising an inlet for spent catalyst, an inlet for a stripping gas, a stripping vapor outlet and a solids outlet for discharge of stripped solids a catalyst regeneration means comprising a coke combustor, a dilute phase transport riser, and a riser outlet catalyst vapor/separation means, connected in series; said coke combustor means being adapted to maintain a fluidized bed of catalyst therein and having an inlet for stripped catalyst connective with said solids outlet from said stripping means, a regeneration gas inlet and an upper outlet for discharge or at least partially regenerated catalyst and flue gas, said coke combustor outlet being connective with an inlet at the base of the dilute phase transport riser and, wherein said coke combustor is essentially free of catalyst/gas separation means; a dilute phase transport riser means extending from said coke combustor means into a containment vessel adapted to maintain a dense phase fluidized bed of regenerated catalyst therein, said riser having an opening at the base connective with said coke combustor outlet which transports at least partially regenerated catalyst and flue gas from the base of the riser to an outlet at an upper portion thereof located within said containment vessel; a riser outlet cyclone separator connective with said transport riser outlet adaptive to immediately separate, isolate and remove said said flue gas and discharge separated catalyst down via a dipleg to form a second fluidized bed of catalyst in said containment vessel; and, a catalyst recycle means connective with said second fluidized bed and said catalytic cracking means for recycle of regenerated catalyst to said cracking means.

DETAILED DESCRIPTION

Figure 1:
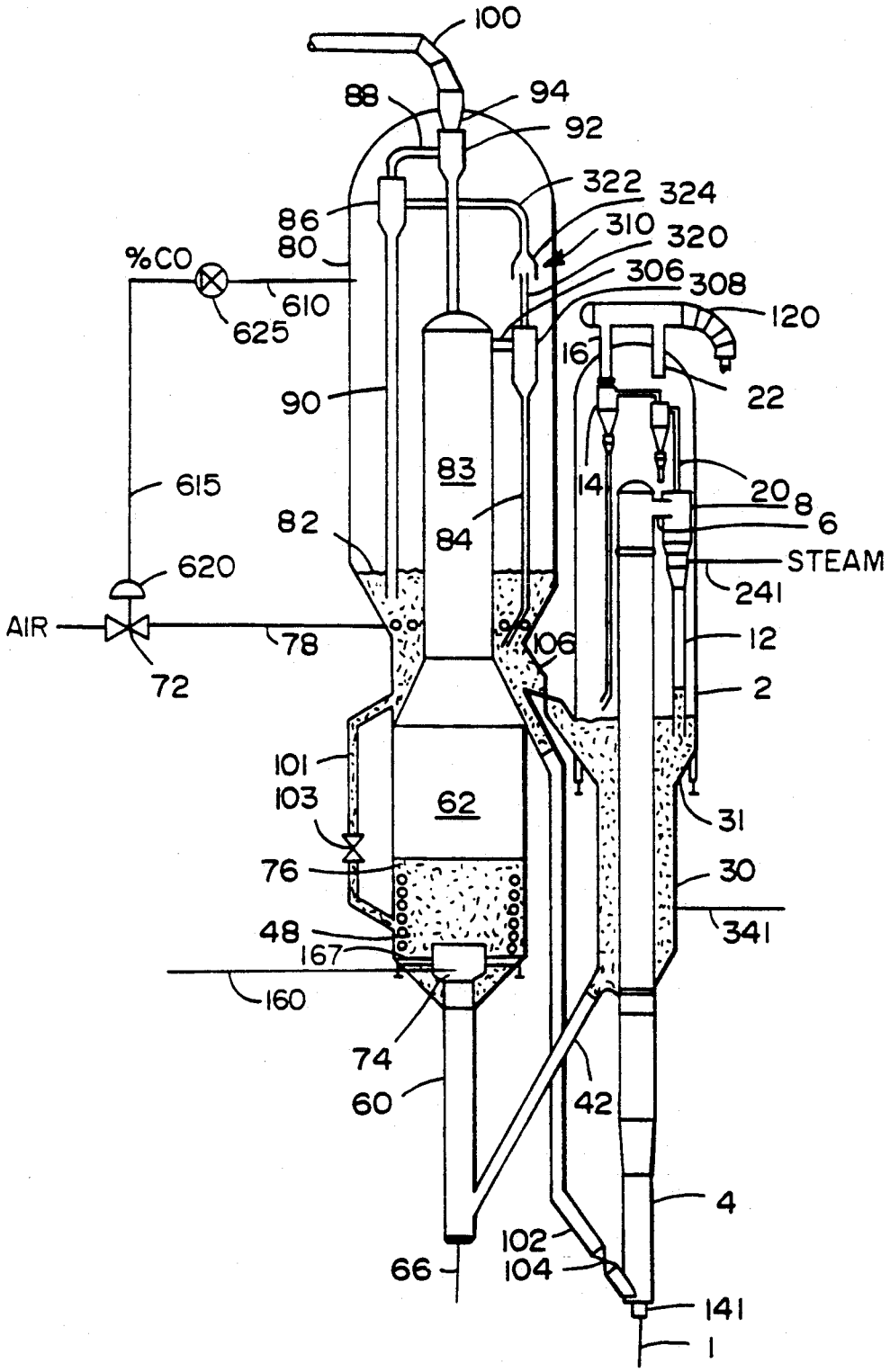
FIG. 1 is a simplified schematic view of an FCC unit with a high efficiency regenerator of the invention.

The present invention can be better understood by reviewing it in conjunction with the Figures, which illustrate high efficiency regenerators of the invention.

A heavy feed is charged via line 1 to the lower end of a riser cracking FCC reactor 4. Hot regenerated catalyst is added via standpipe 102 and control valve 104 to mix with the feed. Preferably, some atomizing steam is added via line 141 to the base of the riser, usually with the feed. With heavier feeds, e.g., a resid, 2–10wt. % steam may be used. A hydrocarbon-catalyst mixture rises as a generally dilute phase through riser 4. Cracked products and coked catalyst are discharged via riser effluent conduit 6 into first stage cyclone 8 in vessel 2. The riser top temperature, the temperature in conduit 6, ranges between about 480° and 615° C. (900° and 1150° F.), and preferably between about 538° and 595° C. (1000° and 1050° F.). The riser top temperature is usually controlled by adjusting the catalyst to oil ratio in riser 4 or by varying feed preheat.

Cyclone 8 separates most of the catalyst from the cracked products and discharges this catalyst down via dipleg 12 to a stripping zone 30 located in a lower portion of vessel 2. Vapor and minor amounts of catalyst exit cyclone 8 via gas effluent conduit 20 and flow into second stage reactor cyclones 14. The second stage cyclone 14, actually multiple cyclones in series, recovers some additional catalyst which is discharged via diplegs to the stripping zone 30.

The second stage cyclone overhead stream, cracked products and catalyst fines, passes via effluent conduit 16 and line 120 to product fractionators not shown in the figure. Stripping vapors enter the atmosphere of the vessel 2 and exit this vessel via outlet line 22.

The coked catalyst discharged from the cyclone diplegs collects as a bed of catalyst 31 in the stripping zone 30. The cyclone diplegs are sealed by being extended into the catalyst bed 31 or are sealed by a trickle valve 19.

Although only a few cyclones 8 and 14 are shown, many cyclones, are usually used in each cyclone separation stage. A preferred closed cyclone system is described in U.S. Pat. No. 4,502,947 to Haddad et al, which is incorporated by reference.

Stripper 30 is a "hot stripper." Hot stripping is preferred, but not essential. Spent catalyst is mixed in bed 31 with hot catalyst from the regenerator. Direct contact heat exchange heats spent catalyst. The regenerated catalyst, which has a temperature from 55° C. (100° F.) above the stripping zone 30 to 871° C. (1600° F.), heats spent catalyst in bed 31. Catalyst from regenerator 80 enters vessel 2 via transfer line 106, and a slide valve which controls catalyst flow. Adding hot, regenerated catalyst permits first stage stripping at from 55° C. (100° F.) above the riser reactor outlet temperature and 816° C. (1500° F.). Preferably, the first stage stripping zone operates at least 83° C. (150° F.) above the riser top temperature, but below 760° C. (1400° F.).

In bed 31 a stripping gas, preferably steam, flows countercurrent to the catalyst. The stripping gas is preferably introduced into the lower portion of bed 31 by one or more conduits 341. The stripping zone bed 31 preferably contains trays or baffles not shown. Stripping steam may also be added to the riser cyclones, via steam line 241, if desired.

High temperature stripping removes coke, sulfur and hydrogen from the spent catalyst. Coke is removed because carbon in the unstripped hydrocarbons is burned as coke in the regenerator. The sulfur is removed as hydrogen sulfide and mercaptans. The hydrogen is removed as molecular hydrogen, hydrocarbons, and hydrogen sulfide. The removed materials also increase the recovery of valuable liquid products, because the stripper vapors can be sent to product recovery with the bulk of the cracked products from the riser reactor. High temperature stripping can reduce coke load to the regenerator by 30 to 50% or more and remove 50–80% of the hydrogen as molecular hydrogen, light hydrocarbons and other hydrogen-containing compounds, and remove 35 to 55% of the sulfur as hydrogen sulfide and mercaptans, as well as a portion of nitrogen as ammonia and cyanides.

Although a hot stripping zone is shown in FIG. 1, the present invention is not, per se, the hot stripper. The process of the present invention may also be used with conventional strippers, or with long residence time steam strippers, or with strippers having internal or external heat exchange means.

Although not shown in FIG. 1, an internal or external catalyst stripper/cooler, with inlets for hot catalyst and fluidization gas, and outlets for cooled catalyst and stripper vapor, may also be used where desired to cool stripped catalyst before it enters the regenerator.

The stripped catalyst passes through the conduit 42 into regenerator riser 60. Air from line 66 and stripped catalyst combine and pass up through an air catalyst disperser 74 into coke combustor 62 in regenerator 80. In bed 62, combustible materials, such as coke on the catalyst, are burned by contact with air or oxygen containing gas.

Preferably the amount of air or oxygen containing gas added via line 66, to the base of the riser mixer 60, is restricted to 50–95% of total air addition to the regenerator 80. Restricting the air addition slows down to some extent the rate of carbon burning in the riser mixer, and in the process of the present invention it is the intent to minimize as much as possible the localized high temperature experienced by the catalyst in the regenerator. Limiting the air limits the burning and temperature rise experienced in the riser mixer, and limits the amount of catalyst deactivation that occurs there. It also ensures that most of the water of combustion, and resulting steam, will be formed at the lowest possible temperature.

Additional air, preferably 5–50% of total air, is preferably added to the coke combustor via line 160 and air distribution arms 167. In this way the regenerator 80 can be supplied with as much air as desired, and can achieve complete afterburning of CO to CO2, even while burning much of the hydrocarbons at relatively mild, even reducing conditions, in riser mixer 60.

To achieve the high temperatures usually needed for rapid coke combustion, and to promote CO afterburning, the temperature of fast fluidized bed 76 in the coke combustor 62 may be, and preferably is, increased by recycling some hot regenerated catalyst thereto via line 101 and control valve 103. If temperatures in the coke combustor are too high, some heat can be removed via catalyst cooler 48, shown as tubes immersed in the fast fluidized bed in the coke combustor. Very efficient heat transfer can be achieved in the fast fluidized bed, so it may be in some instances beneficial to both heat the coke combustor (by recycling hot catalyst to it) and to cool the coke combustor (by using catalyst cooler 48) at the same time.

In coke combustor 62 the combustion air, regardless of whether added via line 66 or 160, fluidizes the catalyst in bed 76, and subsequently transports the catalyst continuously as a dilute phase through the regenerator riser 83. The dilute phase passes upwardly through the riser 83, through riser outlet 306 into primary regenerator cyclone 308. Catalyst is discharged down through dipleg 84 to form a second relatively dense bed of catalyst 82 located within the regenerator 80.

While most of the catalyst passes down through the dipleg 84, the flue gas and some catalyst pass via outlet 310 into enlarged opening 324 of line 322. This ensures that most of the flue gas created in the coke combustor or dilute phase transport riser, and most of the water of combustion present in the flue gas, will be isolated from, and quickly removed from, the atmosphere of vessel 80. The steam laden flue gas will not impinge on, or contact, nor hydrothermally deactivate, the catalyst collected in the second fluidized bed 82. The flue gas from the regenerator riser cyclone gas outlet is almost immediately charged via lines 320 and 322 into the inlet of another cyclone separation stage, cyclone 86. An additional stage of separation of catalyst from flue gas is achieved, with catalyst recovered via dipleg 90 and flue gas discharged via gas exhaust line 88. Preferably flue gas is discharged to yet a third stage of cyclone separation, in third stage cyclone 92. Flue gas, with a greatly reduced solids content, is discharged from the regenerator 80 and from cyclone 92 via exhaust line 94 and line 100.

The hot, regenerated catalyst discharged from the various cyclones forms the bed 82, which is substantially hotter than any other place in the regenerator, and much hotter than the stripping zone 30. Bed 82 is at least 55° C. (100° F.) hotter than stripping zone 31, and preferably at least 83° C. (150° F.) hotter. The regenerator temperature is, at most, 871° C. (1600° F.) to prevent deactivating the catalyst.

Preferably, air is also added via valve 72 and line 78 to dense bed 82. Dense bed 82 preferably contains significantly more catalyst inventory than is conventionally used in high efficiency regenerators. Adding combustion air to second fluidized bed 82 shifts some of the coke combustion to the relatively dry atmosphere of dense bed 82, and minimizes hydrothermal degradation of catalyst. The additional inventory, and increased residence time, in bed 82 permit 5 to 70%, and preferably 10 to 60% and most preferably 30 to 55%, of the coke content on spent catalyst to be removed under relatively dry conditions. This is a significant change from the way high efficiency regenerators have previously operated, with very limited catalyst inventories in the second fluidized bed 82.

There is an additional benefit, in that the staged addition of air limits the temperature rise experienced by the catalyst at each stage, and limits somewhat the amount of time that the catalyst is at high temperature.

Preferably, the amount of air added at each stage (riser mixer 60, coke combustor 62, transport riser 83, and second fluidized bed 82) is monitored and controlled to have as much hydrogen combustion as soon as possible and at the lowest possible temperature, while carbon combustion occurs as late as possible, with highest temperatures reserved for the last stage of the process. In this way, most of the water of combustion, and most of the extremely high transient temperatures due to burning of poorly stripped hydrocarbon occur in riser mixer 60 where the catalyst is coolest. The steam formed will cause hydrothermal degradation of the zeolite, but the temperature will be so low that activity loss will be minimized. Reserving some of the coke burning for the second fluidized bed will limit the highest temperatures to the driest part of the regenerator. The water of combustion formed in the riser mixer, or in the coke combustor, will not contact catalyst in the second fluidized bed 82, because of the catalyst flue gas separation which occurs exiting the dilute phase transport riser 83.

Regardless of the relative amounts of combustion that occur in the various zones of the regenerator, and regardless of whether complete or only partial CO combustion is achieved, the catalyst in the second fluidized bed 82 will be the hottest catalyst, and will be preferred for use as a source of hot, regenerated catalyst for heating spent, coked catalyst in the catalyst stripper of the invention. Preferably, some hot regenerated catalyst is withdrawn from dense bed 82 and passed via line 106 into dense bed of catalyst 31 in stripper 30. Hot regenerated catalyst passes through line 102 and catalyst flow control valve 104 for use in heating and cracking of fresh feed.

In the FIG. 1 embodiment, flue gas analyzers such as CO analyzer controller 625 and probe 610 are preferably used to monitor composition of vapor in the dilute phase region above second fluidized bed 82, and maintain either complete or partial CO combustion. An increase in CO content can cause a signal to be sent via control line 615 to valve controller 620 on valve 72 to cause more air to be added. A flue gas analyzer may also be connected to regenerator riser outlet 306 and control air addition via line 160 to the coke combustor to maintain either partial or complete CO combustion therein, or in the transport riser 83.

The two combustion zones are tied together. Flue gas from combustor 82 is combined with flue gas from zone 62 in annular vent 324 thus tying the two zones together. Preferably both zones operate in either full or partial CO combustion mode.

FIG. 2 EMBODIMENT

Figure 2:
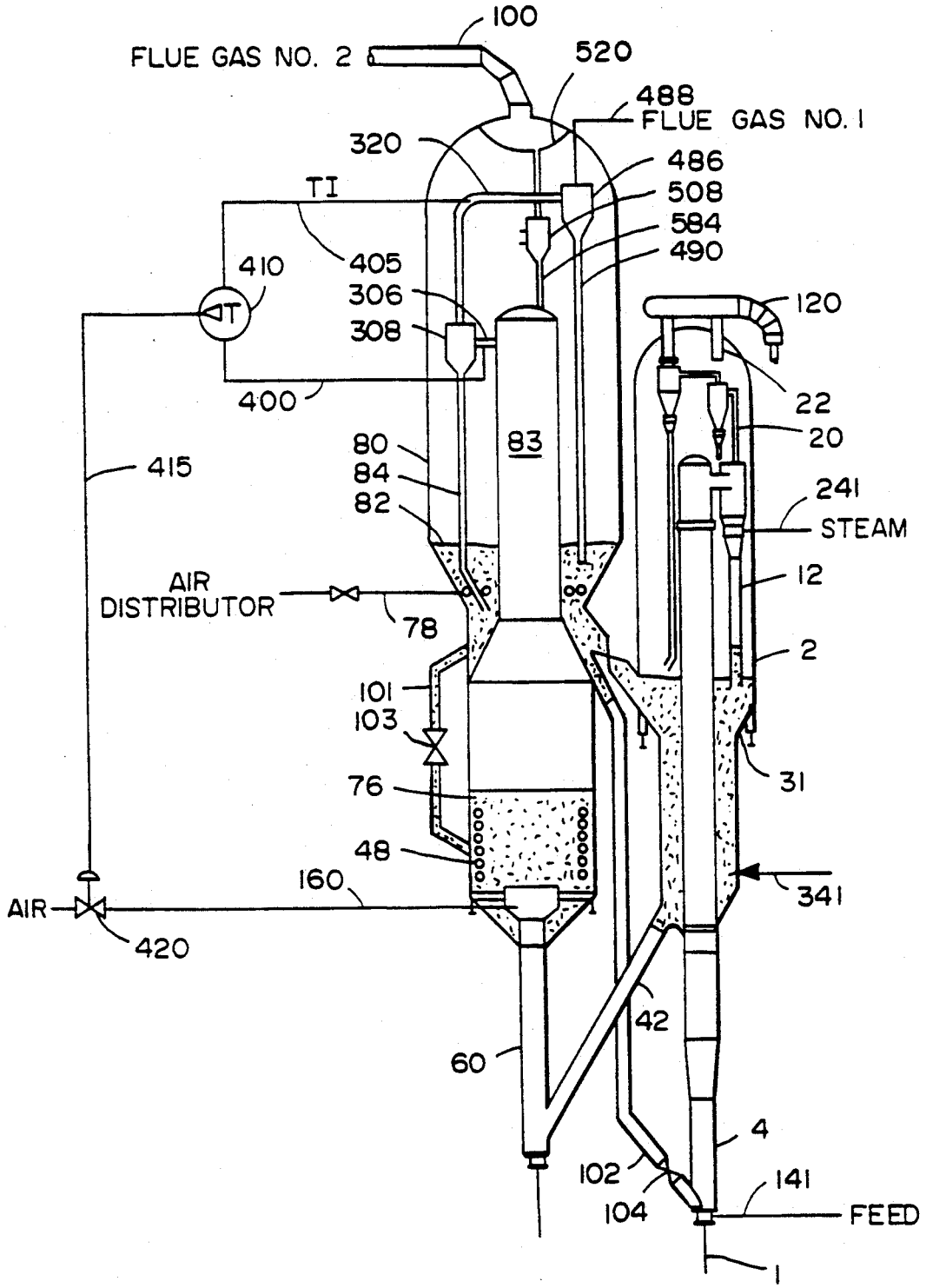
FIG. 2 is a simplified schematic view of a high efficiency regenerator of the invention, with a preferred control system for regulating air addition and distribution.

In the embodiment shown in FIG. 2, the reactor and stripper are identical to the embodiment shown in FIG. 1, and much of the regenerator equipment is the same, e.g., riser reactor 4 is the same in both figures. The riser mixer, coke combustor and transport riser are essentially the same in both figures. Like elements in each Fig. have the same reference numeral.

The coke combustor and the second fluidized bed can operate independently in the FIG. 2 embodiment. A different method of controlling air addition to the various stages of the regenerator is possible.

Differential temperature controller 410 receives signals from thermocouples or other temperature sensing means 400 and 405 responding to temperatures in the inlet and vapor outlet, 306 and 320, respectively, of the cyclone 308 associated with the regenerator transport riser outlet. A change in temperature, delta T, indicates afterburning. An appropriate signal is then sent via control line 415 to alter air flow across valve 420 and regulate air addition to the coke combustor via line 160. Air addition to the upper dense bed can be controlled conventionally, e.g., with a valve regulating air flow in line 78. It is also possible to perform all of the catalyst regeneration in the coke combustor and transport riser, in which case only modest, and constant amounts of fluffing air need be added via line 78 to keep bed 82 aerated.

If complete afterburning upstream of the cyclones is sought, and temperatures are high enough and/or sufficient CO combustion promoter such as Pt is present, then adding more combustion air to the coke combustor will reduce or eliminate afterburning.

Partial CO combustion may be desired, either to limit heat release in the regenerator, minimize NOx emissions, or increase the hot burning capacity of the regenerator. To control air addition to achieve this, then afterburning, or an increase in delta T, will require a decrease in air addition to the coke combustor.

In the FIG. 2 embodiment, the flue gas trains are completely separate. The coke combustion zones may operate independently of each other, with either zone operating in partial or complete CO combustion mode.

Flue gas and catalyst discharged from the FIG. 2 transport riser 83 are charged via line 306 to a cyclone separator 308. Catalyst is discharged down via dipleg 84 to second fluidized bed 82 in regenerator 80. Flue gas, and water of combustion present in the flue gas, are removed from cyclone 308 via line 320 and charged to a secondary cyclone 486 for another stage of separation of catalyst from flue gas. Catalyst recovered in this second stage of cyclone separation is discharged via dipleg 490, which is sealed by being immersed in second fluidized bed 82. The cyclone dipleg could also be sealed with a flapper valve. Flue gas from the second stage cyclone 486 is removed from the containment vessel via line 488. Both cyclones 308 and 486 are isolated from the gas environment within vessel 80.

There is also a flue gas stream generated by coke combustion in second fluidized bed 82. This flue gas will be very hot and very dry. It will be hot because the second fluidized bed is usually the hottest place in a high efficiency regenerator. It will be dry because all of the "fast coke" or hydrogen content of the coke will have been burned from the catalyst upstream of the second fluidized bed. Much and perhaps most of the hydrogen burns in the riser mixer. Such hydrogen as survives the riser mixer is essentially completely eliminated by passage through the coke combustor and the dilute phase transport riser. The coke surviving to exit the transport riser outlet will have an exceedingly low hydrogen content, less than 5%, and frequently less than 2% or even 1%. This coke can be burned in the second fluidized bed to form either CO2 or a mixture of CO and CO2, but there will be very little water formed in the burning of this coke. Thus the flue gas from coke combustion in bed 82 is different, and is handled differently, from flue gas exiting the transport riser.

The hot dry flue gas produced by coke combustion in bed 82 usually has a much lower fines/catalyst content than flue gas from the transport riser. This is because the superficial vapor velocities in bed 82 and much less than vapor velocities used to form a fast fluidized bed in the coke combustor. The coke combustor and transport riser only work effective when all of the catalyst is entrained out of them, while the second fluidized bed works best when none of the catalyst is carried into the dilute phase. This reduced vapor velocity in the second fluidized bed permits use of a single stage cyclone 508 to recover entrained catalyst from dry flue gas. The catalyst recovered is discharged down via dipleg 584 to return to the second fluidized bed. The hot, dry flue gas is discharged via cyclone outlet 520 which connects with vessel outlet 100.

Because the two flue gas streams are isolated, great flexibility in operation is permitted. When a CO combustion boiler is present, or other means of dealing with CO in flue gas both the coke combustor and the second fluidized bed may be operated in partial combustion mode, to minimize heat generation in the regenerator, maximize coke burning capacity in the regenerator, and minimize NOx emissions.

Both sections may be run in complete CO combustion mode, to maximize heat generation in the unit, obtain the cleanest possible catalyst, minimize CO emissions, and obtain extremely hot catalyst.

The coke combustor may be run in partial CO combustion mode to minimize heat release and temperature rise in the relatively high steam pressure atmosphere of the coke combustor, and to minimize NOx emissions. Final cleanup of the catalyst can occur in the second fluidized bed, operating in a highly oxidizing atmosphere to achieve the cleanest possible catalyst while minimizing CO emissions from flue gas from the second fluidized bed. Although such conditions in the second fluidized would normally increase NOx emissions from this bed, in the present invention low NOX emissions will be achieved, because the nitrogen containing coke will essentially have been significantly combusted in the reducing atmosphere of the coke combustor.

The coke combustor may be run in full CO combustion mode, with the second fluidized bed run in partial CO combustion. This can be achieved by operating with large amounts of CO combustion promoter on catalyst, or relatively high spent catalyst throughputs, or relatively high vapor velocities in the coke combustor, or preferably some combination of these. There will not be enough residence time to completely burn the coke in the coke combustor, but the CO combustion reaction will proceed quickly in the dilute phase with large amount of Pt, etc., present, so that partial regeneration, but complete combustion to CO2, is obtained in the coke combustor. The second fluidized bed can be operated in partial CO combustion mode to minimize heat release in the unit. Operating with the coke combustor in complete CO combustion mode, and the second fluidized bed in partial, provides a good way to increase the coke burning capacity of existing high efficiency regenerators. The bulk of the coke combustion can still occur in the coke combustor and dilute phase transport riser to form flue gas with very low CO contents. Extra blower capacity, and a small size CO boiler, can be added to achieve additional coke burning in the second fluidized bed. The design and operation of extra cyclone 508 will be relatively simple, because of the relatively low vapor velocity in the second fluidized bed. The cyclone will not have to handle all the flue gas, just that portion generated in the second fluidized bed. The vapor velocity will be much lower, so catalyst entrainment will be much lower in the dilute phase above the second fluidized bed.

There are several constraints on the process. If complete CO combustion is to be achieved, temperatures in the dilute phase transport riser must be high enough, or the concentration of CO combustion promoter must be great enough, or recycle of hot regenerated catalyst must be high enough, to have essentially complete combustion of CO in the transport riser. High temperatures in the coke combustor can be achieved by a high degree of air preheat, adding a readily combustible substance such as torch oil or fuel gas to the coke combustor, or by recycling large amounts of hot regenerated catalyst to the coke combustor. Recycling of hot regenerated catalyst is by far the preferred method.

Limiting combustion air to the coke combustor or to the dilute phase transport riser (to shift some coke combustion to the second fluidized bed 82) will make it more difficult to get complete CO combustion in the transport riser. Higher levels of CO combustion promoter will promote the dilute phase burning of CO in the transport riser while having much less effect on carbon burning rates in the coke combustor or transport riser.

Increasing catalyst recycle to the coke combustor will also increase coke burning rates by increasing the temperature in the coke combustor and decrease somewhat CO emissions.

If the unit operates in only partial combustion mode, to allow only partial CO combustion, and shift heat generation, to a CO boiler downstream of the regenerator, then much greater latitude re air addition at different points in the regenerator is possible. Partial CO combustion will also greatly reduce emissions of NOx associated with the regenerator. Partial CO combustion is a good way to accommodate unusually bad feeds, with CCR levels exceeding 5 or 10 wt %. Downstream combustion, in a CO boiler, also allows the coke burning capacity of the regenerator to increase and permits much more coke to be burned using an existing air blower of limited capacity.

Now that the invention has been reviewed in connection with the embodiments shown in FIG. 1 and FIG. 2, a more detailed discussion of the different parts of the process and apparatus of the present invention follows. Many elements of the present invention can be conventional, such as the cracking catalyst, or are readily available from vendors, so only a limited discussion of such elements is necessary.

FCC FEED

Any conventional FCC feed can be used. The process of the present invention is especially useful for processing difficult charge stocks, those with high levels of CCR material, exceeding 2, 3, 5 and even 10 wt % CCR. The process, especially when operating in a partial CO combustion mode, tolerates feeds which are relatively high in nitrogen content, and which otherwise might result in unacceptable NOx emissions in conventional FCC units.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful with feeds having an initial boiling point above about 650° F.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

Good additives for removal of SOx are available from several catalyst suppliers, such as Davison's "R" or Katalistiks International, Inc.'s "DeSox."

CO combustion additives are available from most FCC catalyst vendors.

The FCC catalyst composition, per se, forms no part of the present invention.

FCC REACTOR CONDITIONS

Conventional FCC reactor conditions may be used. The reactor may be either a riser cracking unit or dense bed unit or both. Riser cracking is highly preferred. Typical riser cracking reaction conditions include catalyst/oil ratios of 0.5:1 to 15:1 and preferably 3:1 to 8:1, and a catalyst contact time of 0.5–50 seconds, and preferably 1–20 seconds.

It is preferred, but not essential, to use an atomizing feed mixing nozzle in the base of the riser reactor, such as ones available from Bete Fog. More details of use of such a nozzle in FCC processing is disclosed in U.S. Ser. No. 229,670, which is incorporated herein by reference.

It is preferred, but not essential, to have a riser acceleration zone in the base of the riser, as shown in FIGS. 1 and 2.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al.

It is preferred but not essential, to rapidly strip the catalyst, immediately after it exits the riser, and upstream of the conventional catalyst stripper. Stripper cyclones disclosed in U.S. Pat. No. 4,173,527, Schatz and Heffley, may be used.

It is preferred, but not essential, to use a hot catalyst stripper. Hot strippers heat spent catalyst by adding some hot, regenerated catalyst to spent catalyst. A good hot stripper design is shown in U.S. Pat. No. 4,820,404 Owen, which is incorporated herein by reference. A catalyst cooler cools the heated catalyst before it is sent to the catalyst regenerator.

The FCC reactor and stripper conditions, per se, can be conventional and form no part of the present invention.

CATALYST REGENERATION

The process and apparatus of the present invention can use many conventional elements, in addition to some elements which are not conventionally used in FCC regenerators.

The present invention uses as its starting point a high efficiency regenerator such as is shown in the Figures. The essential elements include a coke combustor, a dilute phase transport riser and a second fluidized bed. Preferably, a riser mixer is used. These elements are generally known.

In one embodiment, the present invention provides a quick separation of catalyst from steam laden flue gas exiting the regenerator transport riser. In another embodiment, the invention provides for a significantly increased catalyst inventory in the second fluidized bed of the regenerator, and for significant coke combustion in this second fluidized bed.

Each part of the regenerator will be briefly reviewed below starting with the riser mixer and ending with the regenerator flue gas cyclones.

Spent catalyst and some combustion air are charged to the riser mixer 60. Some regenerated catalyst, recycled through the catalyst stripper, will usually be mixed in with the spent catalyst. Some regenerated catalyst may also be directly recycled to the base of the riser mixer 60, either directly or, preferably, after passing through a catalyst cooler. Riser mixer 60 is a preferred way to get the regeneration started. The rise mixer typically burns most of the fast coke (probably representing entrained or adsorbed hydrocarbons) and a very small amount of the hard coke. The residence time in the riser mixer is usually very short. The amount of hydrogen and carbon removed, and the reaction conditions needed to achieve this removal are reported below.

| RISER MIXER CONDITIONS | Good | Preferred | Best |
|---|---|---|---|
| Inlet Temp. °F. | 900-1200 | 925-1100 | 950-1050 |
| Temp. Increase, °F. | 10-200 | 25-150 | 50-100 |
| Catalyst Residence Time, Seconds | 0.5-30 | 1-25 | 1.5-20 |
| Vapor velocity, fps | 5-100 | 7-50 | 10-25 |
| % total air added | 1-25 | 2-20 | 3-15 |
| H2 Removal, % | 10-40 | 12-35 | 15-30 |
| Carbon Removal, % | 1-10 | 2-8 | 3-7 |

Although operation with a riser mixer is preferred, it is not essential, and in many units is difficult to implement because there is not enough elevation under the coke combustor in which to fit a riser mixer. Spent, stripped catalyst may be added directly to the coke combustor, discussed next.

The coke combustor 62 contains a fast fluidized dense bed of catalyst. It is characterized by relatively high superficial vapor velocity, vigorous fluidization, and a relatively low density dense phase fluidized bed. Most of the coke can be burned in the coke combustor. The coke combustor will also efficiently burn "fast coke", primarily unstripped hydrocarbons, on spent catalyst. When a riser mixer is used, a large portion, perhaps most, of the "fast coke" will be removed upstream of the coke combustor. If no riser mixer is used, relatively easy job of burning the fast coke will be done in the coke combustor.

The removal of hydrogen and carbon achieved in the coke combustor alone (when no riser mixer is used) or in the combination of the coke combustor and riser mixer, is presented below. The operation of the riser mixer and coke combustor can be combined in this way, because what is important is that catalyst leaving the coke combustor have specified amounts of carbon and hydrogen removed.

| COKE COMBUSTOR CONDITIONS | Good | Preferred | Best |
|---|---|---|---|
| Dense Bed Temp. °F. | 900-1300 | 925-1275 | 950-1250 |
| Catalyst Residence Time, Seconds | 10-500 | 20-240 | 30-180 |
| Vapor velocity, fps | 1-40 | 2-20 | 3.5-15 |
| % total air added | 40-100 | 50-98 | 60-95 |
| H2 Removal, % | 50-100 | 60-98 | 70-95 |
| Carbon Removal, % | 40-100 | 50-95 | 60-90 |

The dilute phase transport riser 83 forms a dilute phase where efficient afterburning of CO to CO2 can occur, or (when CO combustion is constrained) efficiently transfers catalyst from the fast fluidized bed through a catalyst separation means to the second fluidized bed.

Additional air can be added to the dilute phase transport riser, but usually it is better to add the air lower down in the regenerator, and speed up coke burning rates some.

In many units it will be beneficial to achieve complete afterburning of CO to CO2 in the transport riser. Usually this will require temperatures of 1200°-1300° F. or higher in the base of the riser, or exiting the coke combustor, and /or the presence of sufficient CO combustion promoter to burn most of the CO to CO2 in the few seconds of gas residence time in the riser.

| TRANSPORT RISER CONDITIONS | Good | Preferred | Best |
|---|---|---|---|
| Inlet Temp. °F. | 900-1300 | 925-1275 | 950-1250 |
| Outlet Temp. °F. | 925-1450 | 975-1400 | 1000-1350 |
| Catalyst Residence Time, Seconds | 1-60 | 2-40 | 3-30 |
| Vapor velocity, fps | 6-50 | 9-40 | 10-30 |
| % additional air in | 0-50 | 0-10 | 0-5 |
| H2 Removal, % | 0-15 | 1-10 | 2-5 |
| Carbon Removal, % | 0-10 | 1-8 | 2-5 |

Quick and effective separation of catalyst from flue gas exiting the dilute phase transport riser is very beneficial for the process. The flue gas contains a fairly large amount of steam, from adsorbed stripping steam entrained with the spent catalyst and from water of combustion. Many FCC regenerators operate with 5-10 psia steam partial pressure in the flue gas. In the process and apparatus of one embodiment of the present invention, the dilute phase mixture is quickly separated into a catalyst rich dense phase and a catalyst lean dilute phase.

The quick separation of catalyst and flue gas sought in the regenerator transport riser outlet is very similar to the quick separation of catalyst and cracked products sought in the riser reactor outlet.

The most preferred separation system is discharge of the regenerator transport riser dilute phase into a closed cyclone system such as that disclosed in U.S. Pat. No. 4,502,947. Such a system rapidly and effectively separates catalyst from steam laden flue gas and isolates and removes the flue gas from the regenerator vessel. This means that catalyst in the regenerator downstream of the transport riser outlet will be in a relatively steam free atmosphere, and the catalyst will not deactivate as quickly as in prior art units.

Other methods of effecting a rapid separation of catalyst from steam laden flue gas may also be used, but most of these will not work as well as the use of closed cyclones. Acceptable separation means include a capped riser outlet discharging catalyst down through an annular space defined by the riser top and a covering cap.

In a preferred embodiment, the transport riser outlet may be capped with radial arms, not shown, which direct the bulk of the catalyst into large diplegs leading down into the second fluidized bed of catalyst in the regenerator. Such a regenerator riser outlet is disclosed in U.S. Pat. No. 4,810,360, which is incorporated herein by reference.

The embodiment shown in FIG. 1 is highly preferred because it is efficient both in separation of catalyst from flue gas and in isolating flue gas from further contact with catalyst. Well designed cyclones can recover in excess of 95, and even in excess of 98% of the catalyst exiting the transport riser. By closing the cyclones, well over 95%, and even more than 98% of the steam laden flue gas exiting the transport riser can be removed without entering the second fluidized bed. The other separation/isolation means discussed about generally have somewhat lower efficiency.

Regardless of the method chosen, at least 90% of the catalyst discharged from the transport riser should be quickly discharged into a second fluidized bed, discussed below. At least 90% of the flue gas exiting the transport riser should be removed from the vessel without further contact with catalyst. This can be achieved to some extent by proper selection of bed geometry in the second fluidized bed, i.e., use of a relatively tall but thin containment vessel 80, and careful control of fluidizing conditions in the second fluidized bed.

The second fluidized bed, in a preferred embodiment of the present invention, is used to achieve a second stage of regeneration of the catalyst, in a relatively dry atmosphere. The multistage regeneration of catalyst is beneficial from a temperature standpoint alone, i.e., it keeps the average catalyst temperature lower than the last stage temperature. This can be true even when the temperature of regenerated catalyst is exactly the same as in prior art units, because when staged regeneration is used the catalyst does not reach the highest temperature until the last stage. The hot catalyst has a relatively lower residence time at the highest temperature, in a multistage regeneration process.

The second fluidized bed bears a superficial resemblance to the second dense bed used in prior art, high efficiency regenerators. There are several important differences which bring about profound changes in the function of the second fluidized bed.

In prior art second dense beds, the catalyst was merely collected and recycled (to the reactor and frequently to the coke combustor). Catalyst temperatures were typically 1250°-1350° F., with some operating slightly hotter, perhaps approaching 1400° F. The average residence time of catalyst was usually 60 seconds or less. A small amount of air, typically around 1 or 2% of the total air added to the regenerator, was added to the dense bed to keep it fluidized and enable it to flow into collectors for recycle to the reactor. The superficial gas velocity in the bed was typically less than 0.5 fps, usually 0.1 fps. The bed was relatively dense, bordering on incipient fluidization. This was efficient use of the second dense bed as a catalyst collector, but meant that little or no regeneration of catalyst was achieved in the second dense bed. Because of the low vapor velocity in the bed, very poor use would be made of even the small amounts of oxygen added to the bed. Large fluidized beds such as this are characterized, or plagued, by generally poor fluidization, and relatively large gas bubbles.

In our process, we make the second fluidized bed do much more work towards regenerating the catalyst. The first step is to provide substantially more residence time in the second fluidized bed. We must have at least 1 minute, and preferably have a much longer residence time. This increased residence time can be achieved by adding more catalyst to the unit, and letting it accumulate in the second fluidized bed.

Much more air is added to our dense bed, for several reasons. First, we are doing quite a lot of carbon burning in the second fluidized bed, so the air is needed for combustion. Second, we need to improve the fluidization in the second fluidized bed, and much higher superficial vapor velocities are necessary. We also decrease, to some extent, the density of the catalyst in the second fluidized bed. This reduced density is a characteristic of better fluidization, and also somewhat beneficial in that although our bed may be twice as high as a bed of the prior art it will not have to contain twice as much catalyst.

Because so much more air is added in our process, we prefer to retain the old fluffing or fluidization rings customarily used in such units, and add an additional air distributor or air ring alongside of, or above, the old fluffing ring.

SECOND DENSE BED CONDITIONS

| | Good | Preferred | Best |
|---|---|---|---|
| Temperature °F. | 1200-1700 | 1300-1600 | 1350-1500 |
| Catalyst Residence Time, Seconds | 30-500 | 45-200 | 60-180 |
| Vapor velocity, fps | 0.5-5 | 1-4 | 1.5-3.5 |
| % total air added | 0-90 | 2-60 | 5-40 |
| H2 Removal, % | 0-15 | 0.1-5 | 0.2-2 |
| Carbon Removal. % | 0-60 | 2-50 | 5-40 |

CO COMBUSTION PROMOTER

Use of a CO combustion promoter in the regenerator or combustion zone is not essential for the practice of the present invention, however, it is preferred. These materials are well-known.

U.S. Pat. No. 4,072,600 and U.S. Pat. No. 4,235,754, which are incorporated b reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit. Pt can be replaced by other metals, but usually more metal is then required. An amount of promoter which would give a CO oxidation activity equal to 0.3 to 3 wt. ppm of platinum is preferred.

Conventionally, refiners add CO combustion promoter to promote total or partial combustion of CO to CO2 within the FCC regenerator. More CO combustion promoter can be added without undue bad effect—the primary one being the waste of adding more CO combustion promoter than is needed to burn all the CO.

The present invention can operate with extremely small levels of CO combustion promoter while still achieving relatively complete CO combustion because the heavy, resid feed will usually deposit large amounts of coke on the catalyst, and give extremely high regenerator temperatures. The high efficiency regenerator design is especially good at achieving complete CO combustion in the dilute phase transport riser, even without any CO combustion promoter present, provided sufficient hot, regenerated catalyst is recycled from the second fluidized bed to the coke combustor. Catalyst recycle to the coke combustor promotes the high temperatures needed for rapid coke combustion in the coke combustor and for dilute phase CO combustion in the dilute phase transport riser.

Usually it will be preferred to operate with much higher levels of CO combustion promoter when either partial CO combustion is sought, or when more than 5-10% of the coke combustion is shifted to the second fluidized bed. More CO combustion promoter is needed because catalysis, rather than high temperature, is being relied on for smooth operation.

The hot stripper reduces the hydrogen content of the spent catalyst sent to the regenerator as a function of residual carbon. Thus, the hot stripper helps control the temperature an amount of hydrothermal deactivation of catalyst in the regenerator.

The rapid separation of catalyst from flue gas in the dilute phase mixture exiting the transport riser removes the water lade flue gas from the catalyst upstream of the second fluidized bed.

Operating the second fluidized bed with more catalyst inventory, and with a much higher superficial vapor velocity, allows an extra stage of catalyst regeneration, either to achieve cleaner catalyst or to more gently remove the carbon and thereby extend catalyst life. Enhanced stability is achieved because much of the regeneration, and much of the catalyst residence time in the regenerator, is under drier conditions than could be achieved in prior art designs.

Staged regeneration also reduces NOx emissions by reserving the most severely oxidizing conditions for the final stage of regeneration. Most of the NOx will be formed in the earlier stages, when conditions are more conducive to reduction of NOx with CO. NOx emissions can be sharply reduced by operating at least some of the upstream portions of the regeneration process at relatively reducing conditions, e.g., with a relatively large riser mixer operated with insufficient air.

ILLUSTRATIVE EMBODIMENT

The process can be conducted using a 343° to 593° C. (650° to 1100° F.) boiling range feed charged to riser reactor 4 to mix with hot (about 760°60 C. (1400° F.) regenerated catalyst and form a catalyst-hydrocarbon mixture. The mixture passes up through riser 4 into effluent conduit 6. The riser top temperature is about 538° C. (1000° F.). Spent catalyst discharged via cyclone diplegs collects a bed of catalyst 31. The hot stripping zone 30 operates at about 1050°-1150° F. Regenerated catalyst, added at a temperature of 1300°-1400° F., heats the stripping zone.

The well stripped catalyst, at a temperature of about 621° C. (1150° F.), combines with air from line 66 in riser mixer 60 to form an air-catalyst mixture. The mixture rises into the coke combustor fast fluid bed 76. Enough hot regenerated catalyst is added to the coke combustor, usually roughly equal to the amount of spent catalyst added to the coke combustor, to get the contents of the coke combustor hot enough to achieve efficient carbon burning. The temperature of the coke combustor is usually around 1250°-1300° F., because of recycle of hot regenerated catalyst, some preheating due to combustion in the riser mixer, and coke combustion in the coke combustor.

The catalyst and combustion air/flue gas mixture elutes up from fast fluid bed 76 through the dilute phase transport riser 83 and into a regenerator vessel 80. The catalyst exiting the riser 83 is separated from steam laden flue gas by closed cyclones 308. A catalyst rich phase passes down through the dipleg 84 to form a second fluidized bed 82. About 5% of the coke on the stripped catalyst burns in the conduit 60, about 55% is burned in the fast fluid bed 62, about 5% in the riser 83, and about 35% in the regenerator vessel 80. Due to the coke burning, the temperature of the catalyst increases as it passes through the unit. Air addition is controlled to each stage so that the temperature in the base of the riser-mixer is about 1000° F., the temperature at the riser mixer outlet is about 1020° F., the temperature in the coke combustor is about 1225°F., and the temperature in the transport riser outlet is about 1245° F. Because a significant amount of coke combustion occurs in the second fluidized bed, the temperature in this bed is about 1375° F.

These temperatures are based on complete CO combustion in both the coke combustor and in the second fluidized bed. Usually complete coke combustion will be preferred, both to minimize air pollution and maximize heat generation in the FCC. When the feed is so heavy that all the heat generated by coke combustion can not be used by the FCC, or removed by various heat exchangers such as 48, or others, then partial CO combustion, in one of more of the coke combustion zones will be necessary. Partial CO combustion will change somewhat the temperature profile reported above.

Catalyst from second fluidized bed 82 supplies catalyst for the cracking reaction via standpipe 102, which leads to the hydrocarbon feedstock. Bed 82 also recycles catalyst via line 106 to the stripping zone 30 to heat spent catalyst. Catalyst is also recycled from bed 82 to the coke combustor via line 101.

STEAMING FACTOR COMPARISON

The process of the present invention significantly reduces the amount of steam damage or deactivation done to catalyst during regeneration. First, the mathematical calculations used to calculate the Steaming Factor will be shown, then the steam deactivation caused by several different regeneration process will be compared.

The steaming factor, SF, is a way to measure the amount of deactivation that occurs in any part of the FCC process. The base case, or a steaming factor of 100, is the amount of catalyst deactivation that occurs in a conventional FCC regenerator operating at a temperature of 1300° F., with a catalyst residence time of 5 minutes, in a regenerator with a steam partial pressure of 6.0 psia.

Steaming factor is a linear function of residence time. If a regenerator operates as above, but the catalyst residence time is 10 minutes, then the SF is 200.

Steaming factor is roughly linear with steam partial pressure.

SF roughly doubles, or halves, with every change of roughly 25° F.

SF may be calculated more exactly using the following equation:

$$SF = \frac{(\text{time} * P_{H2O} * \exp[-Eact/RT]) * 100}{(5) * (6) * \exp[-Eact/R * (977)]}$$

where:

time = catalyst residence time, minutes
(5) = the reference residence. time, 5 minutes
$P_{H2O}$ = the steam partial pressure, psia
(6) = the reference steam pressure, 6 psia
Eact is the energy of activation, or rather deactivation, of zeolites, as determined by laboratory experiments.
T = Temperature, °K.

For a portion of the FCC process operated at 1200° F., for a residence time of 2.5 minutes, and at a steam partial pressure of 10 psia, the SF is 21.

For an FCC process unit operation at 1400° F., a steam partial pressure of 1.0 psia, and a residence time of 5 minutes, the SF is 59.

Five regeneration processes were studied. The basis of the calculation was the regeneration severity needed to produced "clean burned" catalyst, with about 0.05 wt % coke in a regenerator operating in complete CO combustion mode, regenerating catalyst containing 0.65 wt % coke.

SPENT CATALYST COMPOSITION

Wt % coke = 0.65
Coke composition (wt %):
C = 87
H = 10
S = 3
N = 500 ppm

REGENERATOR CONFIGURATIONS

Case I (Prior Art): Single dense bed; steam partial pressure 6 psia (the steam comes from entrained stripping steam (10%) and from water of combustion (90%) and minimal amounts from other sources which are ignored). Residence time of catalyst is 5 minutes. Temperature is 1300° F. SF = 100, by definition.

Case II (Prior Art): High efficiency regenerator, a coke combustor, dilute phase transport riser (no riser cyclone), and a second dense bed (no regen. in 2nd dense bed). The SF of the regenerator is the sum of the SF in the coke combustor through the second dense bed.

Coke Combustor:
Catalyst residence time: 3.5 minutes
Average bed temperature: 1285° F.
Steam partial pressure: 6.0 psia
Steaming Factor Calculated: 58 SF
Dilute Phase Transport Riser:
Catalyst residence time: 0.1 minutes
Average cat. temperature: 1300° F.
Steam partial pressure: 6.0 psia
Steaming Factor Calculated: 2 SF
Second Dense Bed:
Catalyst residence time: 0.75 minutes
Average bed temperature: 1300° F.
Steam partial pressure: 6.0 psia
Steaming Factor Calculated: 15 SF The sum of the steaming factors is 58+2+15, for a total SF of 75. This is substantially less than the SF of 100 in the base case, a single dense bed regenerator, and is a measure of the reduced steaming which occurs in a high efficiency FCC regenerator design. The SF decrease is due to the decreased catalyst inventory, and decreased catalyst residence time in the high efficiency regenerator design.

Case III: High efficiency regenerator as shown in U.S. Pat. No. 4,810,360 (coke combustor, dilute phase transport riser (riser has radial discharge arms), second dense bed (no regeneration in 2nd dense bed). The SF of the regenerator is the sum of the SF in the coke combustor through the second dense bed.

Coke Combustor:
Catalyst residence time: 3.5 minutes
Average bed temperature: 1285° F.
Steam partial pressure: 6.0 psia
Steaming Factor Calculated: 58 SF
Dilute Phase Transport Riser:
Catalyst residence time: 0.1 minutes
Average cat temperature: 1300° F.
Steam partial pressure: 6.0 psi
Steaming Factor Calculated: 2 SF
Second Dense Bed:
Catalyst residence time: 0.75 minutes
Average bed temperature: 1300° F.
Steam partial pressure: 5.0 psi
Steaming Factor Calculated: 12.5 SF The sum of the soaking factors is 58+2+12.5, for a total SF of 72.5.

Case IV: High efficiency regenerator as shown in U.S. Pat. No. 4,810,360, but with closed cyclones on the transport riser outlet. The closed cyclones effect a nearly complete separation of steam laden flue gas from catalyst exiting the transport riser. The second fluidized bed is far drier than in the prior art high efficiency regenerators. The SF of the regenerator is the sum of the SF in the coke combustor through the second fluidized bed.

Coke Combustor:
Catalyst residence time: 3.5 minutes
Average bed temperature: 1285° F.
Steam partial pressure: 6.0 psia
Steaming Factor Calculated: 58 SF
Dilute Phase Transport Riser:
Catalyst residence time: 0.1 minutes
Average bed temperature: 1300° F.
Steam partial pressure: 6.0 psia
Steaming Factor Calculated: 2 SF
Second Dense Bed:
Catalyst residence time: 0.75 minutes
Average bed temperature: 1300° F.
Steam partial pressure: 1.4 psia
Steaming Factor Calculated: 3.5 SF The sum of the soaking factors is 58+2+3.5, for a total SF of 63.5.

Case V: A high efficiency regenerator, as shown in FIG. 1, was studied. This used staged combustion in riser mixer, coke combustor, closed cyclones on transport riser outlet, and combustion of 50% of the coke on spent catalyst in the second fluidized bed. The SF of the regenerator is the sum of the SF in the riser mixer through the second fluidized bed.

Riser Mixer:
Catalyst residence time: 0.15 minutes
Average bed temperature: 1050° F.
Steam partial pressure: 2.1 psia Steaming Factor Calculated: 0.02 SF Coke Combustor:

Catalyst residence time: 3.5 minutes

Average bed temperature: 1175° F.

Steam partial pressure: 9.0 psia

Steaming Factor Calculated: 18 SF

Dilute Phase Transport Riser:

Catalyst residence time: 0.2 minutes

Average bed temperature: 1190° F.

Steam partial pressure : 8.5 psia

Steaming Factor Calculated: 1.2 SF

Second Dense Bed:

Catalyst residence time: 3.0 minutes

Average bed temperature: 1300° F.

Steam partial pressure: 1.5 psia

Steaming Factor Calculated: 15 SF

The sum of the steaming factors is 0.02+18+1.2+15, for a total SF of 34.22

The conventional, single dense bed regenerator (Case I) has a steaming factor of 100.

The high efficiency regenerator design used extensively commercially (Case II) has a steaming factor of 75.

The process of the present invention (Case V) regenerates the catalyst without steaming it to death. The steaming factor is only 34.22, roughly less than half the steaming that occurs in conventional high efficiency regenerators. The reduced steaming of the catalyst translates into increased catalyst activity for the refiner, and reduced catalyst makeup rates.

There are several additional benefits not reflected in the above calculations which would occur in practice. When processing heavy, metals laden feeds migration of vanadium, which is strongly influenced by steam partial pressure and temperature, will be greatly reduced.

NOx emissions will also be reduced when using the process and apparatus of the present invention, though for very different reasons. Most of the nitrogen compounds are burned at lower temperatures, and somewhat more reducing conditions than could be achieved in the prior art regeneration designs.

The process of the present invention can be readily added to existing high efficiency regenerators. Most of the regenerator can be left untouched, as the riser mixer (if used), the coke combustor, and the dilute phase transport riser require no modification. In existing units it is very difficult to modify, e.g., the coke combustor, because this is a fast fluidized bed, and adding equipment to it would adversely affect its operation. In our process, it is possible to achieve most of the benefits of true multi-stage regeneration, without resorting to the expense and complications of adding a catalyst/flue gas separator to a coke combustor.

The process of the present invention can be easily added to existing regenerators. The coke combustor, which usually has no spare room in it for modifications, does not have to be touched.

The only modification that is needed to existing high efficiency regenerators is incorporation of a closed cyclone system at the exit of the dilute phase transport riser to rapidly and completely separate catalyst from steam laden flue gas. The steam laden flue gas should be isolated from the catalyst collected in the second fluidized bed.

Preferably much, and even most, of the coke combustion occurs in the dry atmosphere of the second fluidized bed. Temperatures in the second fluidized bed are high, so rapid coke combustion can be achieved even in a bubbling fluidized bed.

The process and apparatus of the present invention also permits continuous on stream optimization of the regeneration process. Two powerful and sensitive methods of controlling air addition rates permit careful fine tuning of the process.

Measurement of oxygen concentration in flue gas exiting the transport riser, and to a lesser extent measurement of CO or hydrocarbons or oxidizing or reducing atmosphere, gives refiners a way to make maximum use of air blower capacity.

Measurement of delta T, when cyclone separators are used on the regenerator transport riser outlet, provides a very sensitive way to monitor the amount of afterburning occurring.

We claim:

1. A fluidized catalytic cracking process wherein a heavy hydrocarbon feed comprising hydrocarbons having a boiling point above about 650° F. is catalytically cracked to lighter products comprising the steps of:

a. catalytically cracking said feed in a catalytic cracking zone operating at catalytic cracking conditions by contacting said feed with a source of hot regenerated catalyst to produce a cracking zone effluent mixture comprising cracked products and spent cracking catalyst containing strippable hydrocarbons and coke comprising carbon and hydrogen, and;

b. separating said cracking zone effluent mixture into a cracked product rich vapor phase and a solids rich phase comprising said spend catalyst and strippable hydrocarbons;

c. stripping said catalyst mixture with a stripping gas to remove strippable compounds from spent catalyst and produce a stripped catalyst;

d. regenerating said stripped catalyst by contacting said catalyst with recycled regenerated catalyst and oxygen or an oxygen containing gas in a dense phase fluidized bed coke combustor comprising a fluidized bed with inlets for oxygen containing gas, for recycled regenerated catalyst and for stripped catalyst, and an overhead outlet for at least partially regenerated catalyst and flue gas comprising CO2 and water vapor formed by combustion of carbon and hydrocarbon in said coke, wherein said coke combustor is essentially free of catalyst/gas separation means and said coke combustor is below, and in open fluid communication with, a superimposed, dilute phase transport riser having an opening at the base connective with said coke combustor which transports at least partially regenerated catalyst and flue gas from the base of the riser to an outlet at an upper portion thereof;

e. discharging and immediately separating in a cyclone separation means catalyst and flue gas comprising water vapor discharged as a dilute phase from said dilute phase transport riser outlet into a catalyst rich phase and a water vapor rich flue gas phase having a steam partial pressure of 3.5 to 7 psia and comprising over 90% of the water formed by combustion of hydrogen in said coke and discharging said separated catalyst down from said cyclones to form a second fluidized bed of catalyst maintained as a fluidized bed about said transport riser, and having a dilute phase region above said second fluidized bed having a steam partial pressure less than 20% of the steam partial pressure of the water vapor rich flue gas exiting the dilute phase transport riser, and discharging said separated water vapor rich flue gas phase into a flue gas removal means which is isolated from and closed to said second fluidized bed and the dilute phase vapor region above said second fluidized bed and adapted to remove flue gas from said regeneration means; and f. recycling to the catalytic cracking process and to the coke combustor hot regenerated catalyst from said second fluidized bed.

2. The process of claim 1 wherein stripped catalyst, recycled regenerated catalyst and at least a portion of the oxygen or oxygen containing regeneration gas added to the coke combustors are added via a vertical riser mixer having an inlet in a base thereof for said regeneration gas, stripped catalyst and recycled regenerated catalyst and an outlet in an upper portion thereof, and said riser mixer is beneath and connective with the coke combustor, and wherein 1–40% of the hydrogen content, and 0.5–10% of the carbon content of the coke on the stripped catalyst is burned in said riser mixer.

3. The process of claim 2 wherein 2 to 20% of the regeneration gas added to the coke combustor is added via the riser mixer, and 80 to 98% is added to the coke combustion zone.

4. The process of claim 1 wherein sufficient regeneration gas is added to said second fluidized bed to burn from 5 to 50% of the coke on stripped catalyst.

5. The process of claim 1 wherein sufficient regeneration gas is added to said second fluidized bed to burn a majority of the coke on stripped catalyst.

6. The process of claim 2 wherein at least 90% of the hydrogen content of the stripped catalyst is burned upstream of the riser mixer outlet and a majority of the coke combustion occurs downstream of the dilute phase transport riser outlet.

7. The process of claim 1 wherein essentially all of the coke combustion occurs upstream of the dilute phase transport riser outlet and essentially no coke combustion occurs in the second fluidized bed.

8. The process of claim 1 wherein a CO combustion promoter comprising 0.01 to 50 ppm of platinum group metal or other metal with an equivalent CO oxidation activity, on an elemental metal basis, based on the weight of particles in the regenerator, is present on the cracking catalyst.

9. A fluidized catalytic cracking process wherein a heavy hydrocarbon feed comprising hydrocarbons having a boiling point above about 650° F. is catalytically cracked to lighter products comprising the steps of:

a. catalytically cracking said feed in a catalytic cracking zone operating at catalytic cracking conditions by contacting said feed with a source of hot regenerated catalyst to produce a cracking zone effluent mixture and comprising cracked products and spent cracking catalyst containing coke comprising carbon and hydrogen, and strippable hydrocarbons;

b. separating said cracking zone effluent mixture into a cracked product rich vapor phase and a solids rich phase comprising said spent catalyst and strippable hydrocarbons;

c. stripping said catalyst mixture with a stripping gas to remove strippable compounds from spent catalyst and produce stripped catalyst;

d. regenerating said stripped catalyst by contacting said catalyst with recycled regenerated catalyst and oxygen or an oxygen containing regeneration gas to form partially regenerated catalyst and flue gas comprising water formed by combustion of stripped catalyst in a fast fluidized bed coke combustor having inlets in a lower portion thereof for oxygen containing gas, for recycled regenerated catalyst and for stripped catalyst, and an overhead outlet for partially regenerated catalyst and flue gas comprising water formed by combustion, wherein said coke combustor is essentially free of catalyst/gas separation means and is beneath and open to a superimposed, dilute phase transport riser having an opening at the base connective with said coke combustor which transports at least partially regenerated catalyst and flue gas from the base of the riser to an outlet at an upper portion thereof;

e. discharging and immediately separating said catalyst and flue gas gas having a steam partial pressure of 3.5 to 7 psia and comprising all of the water vapor formed by combustion from said dilute phase riser outlet via at least one cyclone separator means having an inlet connective with said outlet of said transport riser, said cyclone separator having a catalyst outlet comprising a dipleg which discharges recovered catalyst down to form a second fluidized bed and discharges recovered flue gas and all the water vapor formed by combustion upstream of the transport riser outlet via a vapor outlet connected with a flue gas outlet means which removes discharged flue from the regenerator without contact with said second fluidized bed or a dilute phase region having a steam partial pressure less than 20% of the steam partial pressure of the water vapor rich flue gas exiting the dilute phase transport riser, above said second fluidized bed;

f. maintaining an inventory of catalyst in said second fluidized bed sufficient to provide a catalyst residence time therein of at least about 1 minute;

g. adding to said second fluidized bed at least 5% of the regeneration gas and maintaining a superficial vapor velocity in said second fluidized bed of at least 0.25 feet per second and removing in said second fluidized bed at least 10% of the carbon content of the coke on stripped catalyst, and h. recycling to the catalytic cracking process.

10. The process of claim 9 wherein said second fluidized bed of catalyst operates at catalyst regeneration conditions including a catalyst residence time of 1 to 4 minutes, a superficial vapor velocity of at least 1.0 foot per second, and wherein 10–90% of the regeneration gas is added to said second fluidized bed and 10–90% of the carbon content of the coke on stripped catalyst is burned in said second fluidized bed.

11. A fluidized catalytic cracking process wherein a heavy hydrocarbon feed comprising hydrocarbons having a boiling point above about 650° F. is catalytically cracked to lighter products comprising the steps of:

a. catalytically cracking said feed in a catalytic cracking zone operating at catalytic cracking conditions by contacting said feed with a source of hot regenerated catalyst to produce a cracking zone effluent mixture comprising cracked products and spent cracking catalyst containing strippable by hydrocarbons and coke comprising carbon and hydrogen; and b. separating said cracking zone effluent mixture into a cracked product rich vapor phase and a solids rich phase comprising said spent catalyst and strippable hydrocarbons;

c. stripping said catalyst mixture with a stripping gas to remove strippable compounds from spent catalyst and produce a stripped catalyst;

d. regenerating said stripped catalyst by contacting said catalyst with recycled regenerated catalyst and oxygen or an oxygen containing gas in a dense phase fluidized bed coke combustor comprising a fluidized bed with inlets for oxygen containing gas, for recycled regenerated catalyst and for stripped catalyst, and an overhead outlet for at least partially regenerated catalyst and flue gas comprising CO2 and water vapor formed by combustion of carbon and hydrogen in said coke, wherein said coke combustor is essentially free of catalyst/gas separation means and said coke combustor is below, and in open fluid communication with, a superimposed, dilute phase transport riser having an opening at the base connective with said coke combustor which transports at least partially regenerated catalyst and flue gas from the base of the riser to an outlet at an upper portion thereof;

e. discharging and immediately separating in a cyclone separation means catalyst and flue gas comprising water vapor discharged as a dilute phase from said dilute phase transport riser outlet into a catalyst rich phase and a water vapor rich flue gas phase having a steam partial pressure and comprising over 90% of the water formed by combustion of hydrogen in said coke and discharging said separated catalyst down from said cyclones to form a second fluidized bed of catalyst maintained as a fluidized bed about said transport riser, and having a dilute phase region above said second fluidized bed having a steam partial pressure less than 20% of the steam partial pressure of the water vapor rich flue gas exiting the dilute phase transport riser, and discharging said separated water vapor rich flue gas phase into a flue gas removal means which is isolated from and closed to said second fluidized bed and the dilute phase vapor region above said second fluidized bed and adapted to remove flue gas from said regeneration means;

f. adding sufficient regeneration gas to said second fluidized bed to burn from 5 to 50% of the coke on stripped catalyst and produce hot regenerated catalyst; and g. recycling of the catalytic cracking process and to the coke combustor hot regenerated catalyst from said second fluidized bed.

* * * * *

UNITED STATES PATENT AND TRADEMARK OFFICE

CERTIFICATE OF CORRECTION

PATENT NO. : 5,183,558

DATED : February 2, 1993

INVENTOR(S) : Hartley Owen et al.

It is certified that error appears in the above-indentified patent and that said Letters Patent is hereby corrected as shown below:

Column 24, line 46, "hydrocarbon" should read --hydrogen--.

Column 26, line 46, after "process" insert --and to the coke combustor hot regenerated catalyst from said second fluidized bed--.

Column 26, line 64, after "strippable", delete "by".

Signed and Sealed this

Fourteenth Day of December, 1993

*Attest:*

Bruce Lehman

BRUCE LEHMAN

*Attesting Officer*

*Commissioner of Patents and Trademarks*